US009911334B2

(12) United States Patent
Townsend

(10) Patent No.: US 9,911,334 B2
(45) Date of Patent: Mar. 6, 2018

(54) CONNECTED VEHICLE TRAFFIC SAFETY SYSTEM AND A METHOD OF WARNING DRIVERS OF A WRONG-WAY TRAVEL

(71) Applicant: SIEMENS INDUSTRY, INC., Alpharetta, GA (US)

(72) Inventor: Walter Rankin Townsend, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/208,006

(22) Filed: Jul. 12, 2016

(65) Prior Publication Data

US 2018/0018877 A1 Jan. 18, 2018

(51) Int. Cl.
*G08G 1/09* (2006.01)
*G08G 1/16* (2006.01)
(Continued)

(52) U.S. Cl.
CPC ..... *G08G 1/166* (2013.01); *G08G 1/056* (2013.01); *G08G 1/096* (2013.01); *G08G 1/096783* (2013.01)

(58) Field of Classification Search
CPC ..... G08G 1/166; G08G 1/056; G08G 1/096; G08G 1/096783; G08G 1/096758;
(Continued)

(56) References Cited

U.S. PATENT DOCUMENTS 6,084,533 A * 7/2000 Morgan ..... G08G 1/056 340/907
6,223,125 B1 * 4/2001 Hall ..... G08G 1/164 701/117

(Continued)

FOREIGN PATENT DOCUMENTS

FR 2723239 A1 2/1996

OTHER PUBLICATIONS

PCT International Search Report and Written Opinion of International Searching Authority dated Aug. 30, 2017 corresponding to PCT International Application No. PCT/US2017/036982 filed Jun. 12, 2017.

*Primary Examiner* — Anh V La

(57) ABSTRACT

A connected vehicle traffic safety system comprises a traffic signal controller and a roadside unit (RSU) located at a one-way traffic lane for avoiding crashes with vehicles of wrong-way drivers by issuing warnings for wrong-way violations. The traffic signal controller is configured to operate a traffic signal. The traffic signal is facing a wrong-way traffic and is set to dwell permanently in a RED signal phase. The one-way traffic lane is configured as a signalized intersection with a wrong-way approach that is programmed as a traffic signal phase dwelling in RED. The roadside unit (RSU) is configured to transmit a Signal Phase and Timing (SPaT) indication for the RED signal phase. A first Onboard Unit (OBU)-equipped vehicle having an Onboard Unit (OBU) that is configured to calculate a RED light violation based on at least one of vehicle location data, direction
(Continued)

heading data, and speed data provided from the first OBU-equipped vehicle and the SPaT indication of the RED signal phase to detect the first Onboard Unit (OBU)-equipped vehicle as a wrong-way vehicle.

20 Claims, 4 Drawing Sheets

(51) Int. Cl.
*G08G 1/056* (2006.01)
*G08G 1/0967* (2006.01)
*G08G 1/096* (2006.01)

(58) Field of Classification Search
CPC .. G08G 1/017; G08G 1/096716; G08G 1/164; G08G 1/162; G08G 1/09626; G08G 1/09623; G08G 1/091; G08G 1/095; G08G 1/096775; G07B 15/063
USPC ..... 340/905, 935, 907, 901, 903, 902, 988, 340/693.5, 693.9, 539.11, 568.1, 568.8; 701/117
See application file for complete search history.

(56) References Cited

U.S. PATENT DOCUMENTS 6,516,273 B1 * 2/2003 Pierowicz ..... B60K 31/0058 340/903
7,667,601 B2 * 2/2010 Rabinowitz ..... G08B 13/1454 340/539.1
7,990,286 B2 * 8/2011 Shankwitz ..... G01C 21/26 340/435
8,265,987 B2 * 9/2012 Goto ..... G07B 15/063 235/384
8,386,156 B2 2/2013 Miller
8,519,868 B2 8/2013 Nadeem et al.
8,576,069 B2 * 11/2013 Nadeem ..... B60H 3/00 340/539.25
8,917,188 B2 * 12/2014 Wietfeld ..... G08G 1/056 340/568.1
8,976,041 B2 3/2015 Buckel
9,013,325 B2 * 4/2015 Miller ..... G08G 1/07 116/63 R
9,460,618 B1 * 10/2016 Soltesz ..... G08G 1/08
2009/0224942 A1 9/2009 Goudy et al.
2010/0261428 A1 10/2010 Goto
2011/0010228 A1 1/2011 Goto
2013/0044009 A1 * 2/2013 Tagawa ..... G08G 1/075 340/995.28
2013/0063282 A1 * 3/2013 Baldwin ..... B61L 29/282 340/941
2013/0338850 A1 * 12/2013 Takahara ..... G01C 21/3697 701/1
2015/0004911 A1 * 1/2015 Schmidt ..... H04L 67/12 455/41.2
2016/0203716 A1 * 7/2016 Jeschke ..... B60W 40/072 701/532
2016/0217688 A1 * 7/2016 Jeschke ..... G06K 9/00798
2016/0225256 A1 * 8/2016 Hofsaess ..... G08G 1/166
2016/0343253 A1 * 11/2016 Imai ..... G06K 9/00818
2017/0015242 A1 * 1/2017 Rentel ..... G08G 1/0962
2017/0018178 A1 * 1/2017 Poechmueller ..... G08G 1/056

* cited by examiner

CONNECTED VEHICLE TRAFFIC SAFETY SYSTEM AND A METHOD OF WARNING DRIVERS OF A WRONG-WAY TRAVEL

BACKGROUND

1. Field

Aspects of the present invention generally relate to a system and a method of avoiding crashes with vehicles of wrong-way drivers by issuing warnings for wrong way violations and more specifically relates to a vehicle active safety system for vehicles equipped with an Onboard Unit (OBU) that prevent collisions based on vehicle trajectories and red light messages.

2. Description of the Related Art

Connected vehicles are becoming a reality, which takes driver assistance towards its logical goal: a fully automated network of cars aware of each other and their environment. A connected vehicle system makes mobility safer by connecting cars to everything.

Vehicular communications systems are networks in which vehicles, personal mobile devices (Onboard Units or OBUs) and roadside units (RSUs) are the communicating nodes, providing each other with information, such as safety warnings and traffic information. They can be effective in avoiding crashes and traffic congestion. Both types of nodes are generally dedicated short-range communications (DSRC) devices. DSRC works in 5.9 GHz band with bandwidth of 75 MHz and approximate range of 1000 m.

Vehicular communications systems are usually developed as a part of intelligent transportation systems (ITS). For example, a Vehicle to Vehicle (V2V) communications system is an automobile technology designed to allow automobiles to "talk" to each other. These systems generally use a region of the 5.9 GHz band set aside by the United States Congress in 1999, the unlicensed frequency also used by Wi-Fi. The V2V communications system is currently in active development by many car makers.

The National Highway Transportation Safety Agency reports approximately 400 highway fatalities occur per year due to wrong-way drivers, such as ones travelling the wrong way on one-way roads and entering freeway exit ramps. This problem has been solved by providing signage, warnings, and barriers. For example, as signage "DO NOT ENTER" and "WRONG WAY" signs are placed at the roadside facing wrong-way drivers. Alternatively, warnings are used such as vehicles travelling in the wrong direction are detected, visual and audible warnings from roadside are provided. Sometimes barriers are used such as vehicles travelling in the wrong direction are detected and blocked by a dropped barrier. However, despite these measures in place, hundreds of highway fatalities occur per year due to wrong-way drivers.

Therefore, there is a need for improvements in predicting and avoiding crashes with vehicles of wrong-way drivers before they occur in a connected vehicle system.

SUMMARY

Briefly described, aspects of the present invention relate to a mechanism for detecting a first Onboard Unit (OBU)-equipped vehicle having an Onboard Unit (OBU) as a wrong-way vehicle travelling in a wrong direction on a one-way traffic lane by calculating a RED light violation based on at least one of vehicle location data, direction heading data, and speed data provided from the first OBU-equipped vehicle and a Signal Phase and Timing (SPaT) indication for a RED signal phase of a traffic signal facing a wrong-way traffic. In particular, it relates to a connected vehicle traffic safety system for handling the first Onboard Unit (OBU)-equipped vehicle as a red light violator by providing a RED light warning to a driver of the first OBU-equipped vehicle. One of ordinary skill in the art appreciates that such a connected vehicle system can be configured to be installed in different environments where drivers are warned of predicted wrong-way crashes, for example, based on red light violations on a one-way traffic lane that is configured as a signalized intersection and warnings are issued to all vehicles equipped with an OBU to prevent collisions.

In accordance with one illustrative embodiment of the present invention, a connected vehicle traffic safety system is provided. The system comprises a traffic signal controller and a roadside unit (RSU). The traffic signal controller is configured to operate first and second traffic signals S1, S2 or configured to act as if a traffic signal was present as a "virtual" traffic signal. The first traffic signal S1 is facing a right-way traffic and is set to dwell permanently in a GREEN signal phase and the second traffic signal S2 is facing a wrong-way traffic and is set to dwell permanently in a RED signal phase. The roadside unit (RSU) is located at a highway exit ramp being a one-way traffic lane. The roadside unit (RSU) comprising at least a processor and a wireless transceiver. The roadside unit (RSU) is configured to transmit wireless signals and receive corresponding responses from a corresponding wireless device of a first Onboard Unit (OBU)-equipped vehicle having an Onboard Unit (OBU). The roadside unit (RSU) is configured to transmit a Signal Phase and Timing (SPaT) indication for both the GREEN signal phase and the RED signal phase. The SPaT indication of the RED signal phase continually indicates a maximum countdown time to the GREEN signal phase and the SPaT indication of the GREEN signal phase continually indicates a maximum countdown time to the RED signal phase. The one-way traffic lane is configured as a signalized intersection with two approaches. The two approaches include a right-way approach that is programmed as a traffic signal phase dwelling in GREEN and a wrong-way approach that is programmed as a traffic signal phase dwelling in RED. The Onboard Unit (OBU) of the first OBU-equipped vehicle travelling in a wrong direction is configured to calculate a RED light violation based on at least one of vehicle location data, direction heading data, and speed data provided from the first OBU-equipped vehicle and the SPaT indication of the RED signal phase.

In accordance with another illustrative embodiment of the present invention, a method is provided to avoid crashes with wrong-way drivers driving a first Onboard Unit (OBU)-equipped vehicle having an Onboard Unit (OBU) in a wrong way on a highway exit ramp being a one-way traffic lane. The method comprises configuring the one-way traffic lane as a signalized intersection with two approaches, wherein the two approaches include a right-way approach that is programmed as a traffic signal phase dwelling in GREEN and a wrong-way approach that is programmed as a traffic signal phase dwelling in RED, detecting the first Onboard Unit (OBU)-equipped vehicle as a wrong-way vehicle, and handling the first Onboard Unit (OBU)-equipped vehicle as a red light violator using a connected vehicle traffic safety system comprising a traffic signal controller and a roadside unit (RSU).

In accordance with yet another illustrative embodiment of the present invention, a connected vehicle traffic safety system comprises a traffic signal controller and a roadside unit (RSU) located at a one-way traffic lane for avoiding crashes with vehicles of wrong-way drivers by issuing warnings for wrong-way violations. The traffic signal controller is configured to operate a traffic signal or configured to act as if a traffic signal was present as a "virtual" traffic signal. The traffic signal is facing a wrong-way traffic and is set to dwell permanently in a RED signal phase. The one-way traffic lane is configured as a signalized intersection with a wrong-way approach that is programmed as a traffic signal phase dwelling in RED. The roadside unit (RSU) is configured to transmit a Signal Phase and Timing (SPaT) indication for the RED signal phase. A first Onboard Unit (OBU)-equipped vehicle having an Onboard Unit (OBU) that is configured to calculate a RED light violation based on at least one of vehicle location data, direction heading data, and speed data provided from the first OBU-equipped vehicle and the SPaT indication of the RED signal phase to detect the first Onboard Unit (OBU)-equipped vehicle as a wrong-way vehicle.

DETAILED DESCRIPTION

To facilitate an understanding of embodiments, principles, and features of the present invention, they are explained hereinafter with reference to implementation in illustrative embodiments. In particular, they are described in the context of a connected vehicle system for traffic control and monitoring to generating warnings. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

In a connected vehicle system, some vehicles are equipped with an On-Board Unit (OBU). The connected vehicle system serves at least one Onboard Unit (OBU)-equipped vehicle and uses at least one Roadside Unit (RSU) and a traffic signal controller. The OBU privately and securely transmits vehicle location, heading, elevation and speed to nearby vehicles, receives location heading, elevation and speed from nearby vehicles, receives lane locations from a Roadside Unit (RSU), receives traffic signal countdown from the RSU, and receives associated signal phase to lane from the RSU.

Figure 1:
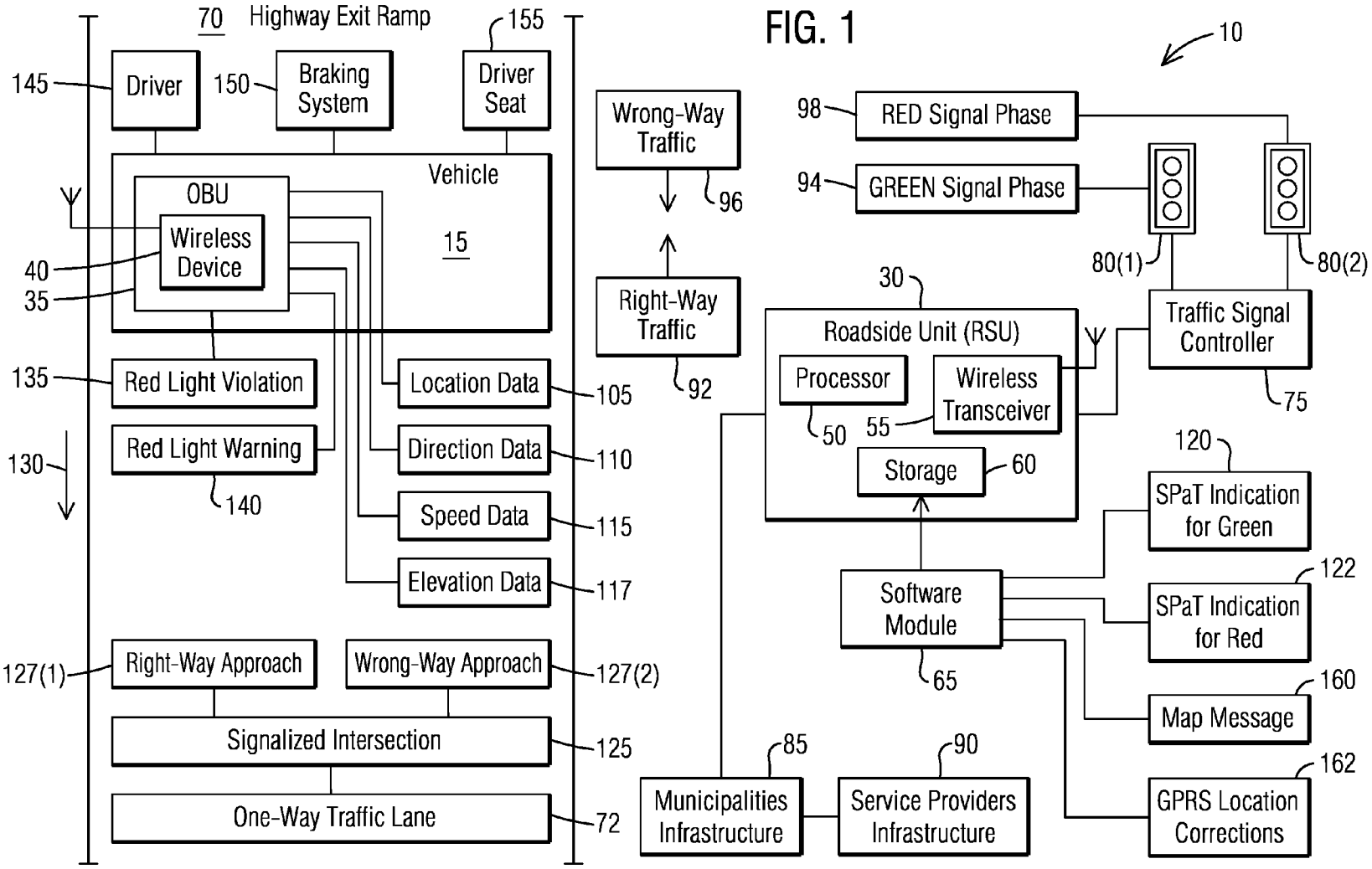
FIG. 1 illustrates a schematic of a connected vehicle system that detects a first Onboard Unit (OBU)-equipped vehicle as a wrong-way vehicle based on data from the first OBU-equipped vehicle and a Signal Phase and Timing (SPaT) indication for a RED signal phase of a traffic signal and provides a RED light warning to a driver of the first OBU-equipped vehicle in accordance with an exemplary embodiment of the present invention.

FIG. 1 illustrates a schematic of a connected vehicle traffic safety system 10 for traffic control and monitoring for generating warnings in accordance with an exemplary embodiment of the present invention. The connected vehicle traffic safety system 10 provides vehicular communications as a part of an intelligent transportation system (ITS). The connected vehicle traffic safety system 10 may enable a network for vehicular communications in which an Onboard Unit (OBU)-equipped vehicle 15 and a Roadside Unit (RSU) 30 act as communicating nodes, providing each other with information, such as safety warnings and traffic information. The RSU 30 has one or more wireless transceivers such as Ethernet, DSRC, Cellular and Wi-Fi that can be used interchangeably.

Consistent with one embodiment, these types of communicating nodes may use dedicated short-range communications (DSRC) devices. DSRC work in the 5.9 GHz frequency band with bandwidth of 75 MHz and has an approximate range of 1000 m. Alternatively however, 5G cellular communications technology or protocols, devices may replace the DSRC devices in the connected vehicle traffic safety system 10 for creating standard messages.

As used herein, "a vehicle (V) equipped with an Onboard Unit (OBU)" refers to a vehicle that connects to sensors, decision-making systems and control systems for enabling a safety system for connected vehicles. As used herein, "a traffic signal controller" refers to a traffic control and monitoring system that connects to sensors, decision-making systems and control systems via a Roadside Unit (RSU) for enabling a traffic safety system for connected vehicles. The "connected vehicle traffic safety system," in addition to the exemplary hardware description above, refers to a system that is configured to provide communications from Vehicle to either another Vehicle (V2V) or to roadside Infrastructure (V2I) for creating an ecosystem of connected vehicles, operated by a controller (including but not limited to smart infrastructure equipment connected to traffic signal light controllers and traffic management systems, and others). The connected vehicle traffic safety system can include multiple interacting systems, whether located together or apart, that together perform processes as described herein.

The Onboard Unit (OBU)-equipped vehicle 15 includes an OBU or OB device 35 that privately and securely: transmit vehicle location, heading and speed data to nearby OBU-equipped vehicles ten times per second, receive vehicle location, heading and speed data from nearby OBU-equipped vehicles, receive lane locations from the Roadside Unit (RSU) 30, receive a traffic signal countdown from the Roadside Unit (RSU) 30, receive an associated signal phase to a lane information from the Roadside Unit (RSU) 30 to know which traffic signal to obey and/or receive a General Packet Radio Service (GPRS) location from the Roadside Unit (RSU) 30 to correct a Global Positioning System (GPS) device the Onboard Unit (OBU) having less accuracy. However, the U.S. Department of Transportation (DOT) defines three classes of OBU devices: i. Class 1: OBU built into the new vehicle, ii. Class 2: OBU available as an aftermarket device for older vehicles, cyclists and pedestrians, and iii. Class 3: OBU available as a smart phone app for drivers, cyclists and pedestrians. Creation and use of this data is not limited to vehicles, but can be created and used by other moving objects, such as pedestrians and bicycles.

The techniques described herein can be particularly useful for using an Onboard Unit (OBU) or OB device. While particular embodiments are described in terms of Onboard Unit (OBU), the techniques described herein are not limited to Onboard Unit (OBU) but can also use other Vehicle to Vehicle/Infrastructure/Traffic Management System (V2X) empowered software and hardware such as other smart automotive interactive communication modules.

The Onboard Unit (OBU)-equipped vehicle 15 use real-time traffic data to provide proactive driver warnings for collisions with other vehicles and to warn drivers of red light violations before they occur. In addition to the Onboard Unit (OBU)-equipped vehicle 15, the real-time traffic data may be created and used by other OBU-connected moving objects, such as pedestrians and bicycles. In this way, by providing a fully automated network of vehicles, pedestrians and bicycles aware of each other and their environment the connected vehicle traffic safety system 10 makes mobility safer.

In the Onboard Unit (OBU)-equipped vehicle 15, the Onboard Unit (OBU) 35 includes a wireless device 40. Likewise, the Roadside Unit (RSU) 30 includes a processor 50, a wireless transceiver 55, and a storage media 60 to store a software module 65. The Roadside Unit (RSU) 30 may be located at a highway exit ramp 70 being a one-way traffic lane 72. The Roadside Unit (RSU) 30 may be coupled to a traffic signal controller 75 connected to a first traffic signal S1 80(1) and a second traffic signal S2 80(2). The Roadside Unit (RSU) 30 may be coupled to municipalities infrastructure 85 which in turn are connected to service providers infrastructure 90.

The traffic signal controller 75 may be connected via a buried fiber to a Traffic Management Centre (TMC) for delivering traffic and travel information to motor vehicle drivers. The traffic signal controller 75 may be connected via Ethernet or Wi-Fi to the Roadside Unit (RSU) 30. The Roadside Unit (RSU) 30 may communicate via 3 radio channels such as a control channel for automatic braking, a service channel for vital signs and a Wi-Fi channel for controller service and evacuation maps etc.

In a cloud, via a switch a RSU provisioning and network management server, a certification authority and a gateway to other networks of the municipalities infrastructure 85 may be connected to the Roadside Unit (RSU) 30. The municipalities infrastructure 85 may handle registrations, subscriptions, operations, rules, management and maintenance. The service providers infrastructure 90 may include an Original Equipment Manufacturer (OEM)/Internet Service Provider (ISP) applications server, a content and services server, and an OBU provisioning server. It should be appreciated that several other components may be included in the municipalities infrastructure 85 and the service providers infrastructure 90. However, the function and use of such equipment for a traffic control application are well known in the art and are not discussed further.

The first traffic signal S1 80(1) and the second traffic signal S2 80(2) may be located at the highway exit ramp 70 on which the Onboard Unit (OBU)-equipped vehicle 15 may travel. The traffic signal controller 75 is configured to operate first and second traffic signals S1, S2 80(1-2) such that the first traffic signal S1 80(1) is facing a right-way traffic 92 and is set to dwell permanently in a GREEN signal phase 94 and the second traffic signal S2 80(2) is facing a wrong-way traffic 96 and is set to dwell permanently in a RED signal phase 98.

Embodiments are described for the system as if the traffic signal actually exists, but in alternative embodiments the traffic signals, signs, and barrier are optional. The normal method of deployment would most likely be without the traffic signals installed, it would just use a "virtual" traffic signal.

One of the key concepts of this present invention is that the traffic signal itself does not need to exist. The traffic signal controller 75 and the RSU 30 are installed and configured to act as if a traffic signal was present on the ramp, so that the correct DSRC SPaT and MAP messages are generated to warn vehicles, but the visible signals do not need to be there. It is not accepted traffic engineering practice to install traffic signals on ramps so this could confuse drivers. This system may be installed in conjunction with a "conventional" wrong way driver warning system, which would use radar or another detection technology to detect non-connected wrong way vehicles, and would use flashing lights and warning signs to warn both the wrong way driver and oncoming motorists. A conventional wrong way driver warning system can't stop vehicles, it can only warn them. The key concept of this present invention is that it can actually stop vehicles, if they are equipped with connected vehicle technologies. Primarily, it would stop the wrong way vehicle, but through the normal collision avoidance capabilities of a connected vehicle OBU, it could also warn or stop vehicles approaching from the correct direction. In addition to the OBU interaction, the RSU 30 and the traffic signal controller 75 could also use the red light violation detection to trigger the "conventional" wrong way warning system (signs and flashers), so that non-connected vehicles would also be alerted.

In operation, the Roadside Unit (RSU) 30 may be configured to transmit wireless signals and receive corresponding responses from the wireless device 40 of the Onboard Unit (OBU)-equipped vehicle 15, and to send vehicle location data 105, direction heading data 110, speed data 115 and elevation data 117 from the OBU-equipped vehicle 15 to the traffic signal controller 75. The elevation data 117 is critical for overpasses as don't need to issue a crash warning based on latitude and longitude if the cars are on different levels of the overpass.

An example of the vehicle location data 105 is GPS co-ordinates, i.e., longitude and latitude co-ordinates of a global location on the surface of Earth by a Global Positioning System (GPS) such as via a Google Maps APP or via a hardware GPS chip. An example of the direction heading data 110 may be a direction indication generated indicating a north (N), south (S), east (E), and west (W), SE, ES, WS, or NW direction of the Onboard Unit (OBU)-equipped vehicle 15 on the highway exit ramp 70. An example of the speed data 115 may be a speed value of the Onboard Unit (OBU)-equipped vehicle 15 on the highway exit ramp 70.

The Roadside Unit (RSU) 30 may transmit a Signal Phase and Timing (SPaT) indication 120 for the GREEN signal phase 94 and a Signal Phase and Timing (SPaT) indication 122 for the RED signal phase 98. The software module 65 of the Roadside Unit (RSU) 30 may provide the SPaT indications 120, 122. For example, a Signal Phase and Timing (SPaT) application may be used by the software module 65 of the Roadside Unit (RSU) 30 to provide the current intersection signal light phases. The current state of all lanes at a single intersection may be provided. This SPaT application may support a variety of V2I applications. The SPaT indication 122 of the RED signal phase 98 may continually indicate a maximum countdown time to the GREEN signal phase 94 and the SPaT indication 120 of the GREEN signal phase 94 may continually indicate a maximum countdown time to the RED signal phase 98.

The one-way traffic lane 72 may be configured as a signalized intersection 125 with two approaches. The two approaches may include a right-way approach 127(1) that is programmed as a traffic signal phase dwelling in GREEN and a wrong-way approach 127(2) that is programmed as a traffic signal phase dwelling in RED. The right-way approach 127(1) is a direction of traffic on the one-way traffic lane 72 in the correct direction as indicated by the first traffic signal S1 80(1) facing the right-way traffic 92. The wrong-way approach 127(2) is a direction of traffic on the one-way traffic lane 72 in the wrong direction as indicated by the second traffic signal S2 80(2) facing the wrong-way traffic 96.

In one embodiment, real-time data about traffic Signal Phase and Timing (referred to as SPaT data) may be broadcast for the signalized intersection 125 and received by OBU-equipped vehicles such as the Onboard Unit (OBU)-equipped vehicle 15. The Onboard Unit (OBU)-equipped vehicle 15 may receive Signal Phase and Timing (SPaT) information over DSRC.

A Vehicle Awareness Device such as the OBU 35 broadcasts a Basic Safety Message (BSM), including vehicle position, direction and speed. Roadside equipment such as the Roadside Unit (RSU) 30 broadcasts Signal Phase and Timing (SPaT) messages. Once OBU-equipped vehicles are aware of the location, direction and speed of other OBU-equipped vehicles, drivers can be warned of any potential roadside dangers, including potential red light violations before entering one-way lanes or intersections and vehicle active safety systems may avoid collisions.

The Onboard Unit (OBU) 35 of the first OBU-equipped vehicle 15 travelling in a wrong direction 130 is configured to calculate a RED light violation 135 based on the vehicle location data 105, direction heading data 110, speed data 115, and/or elevation data 117 provided from the first OBU-equipped vehicle 15 and the SPaT indication 122 of the RED signal phase 98. The Onboard Unit (OBU) 35 of the first OBU-equipped vehicle 15 provides a RED light warning 140 based on the RED light violation 135 to a driver 145 of the first OBU-equipped vehicle 15 in a form of chattering a braking system 150 or a driver's seat 155 to indicate the first OBU-equipped vehicle 15 as a wrong-way vehicle that is to be handled as a red light violator.

The software module 65 of the Roadside Unit (RSU) 30 may send the vehicle location data 105, direction heading data 110, speed data 115, and/or elevation data 117 received from the first OBU-equipped vehicle 15 to the traffic signal controller 75 so that if the driver 145 of the first OBU-equipped vehicle 15 ignores the RED light warning 140, a barrier (see FIG. 5) is dropped across the highway exit ramp 70 and/or a wrong way sign (see FIG. 5) is illuminated adjacent the second traffic signal S2 80(2) by the traffic signal controller 75.

The software module 65 of the Roadside Unit (RSU) 30 may transmit a standard Message Access Profile (MAP) message 160 indicating a roadway lane placement for both RED and GREEN approaches. The software module 65 of the Roadside Unit (RSU) 30 may also transmit General Packet Radio Service (GPRS) location corrections 162 to all OBU-equipped vehicles for accurate vehicle location within lanes.

Figure 2:
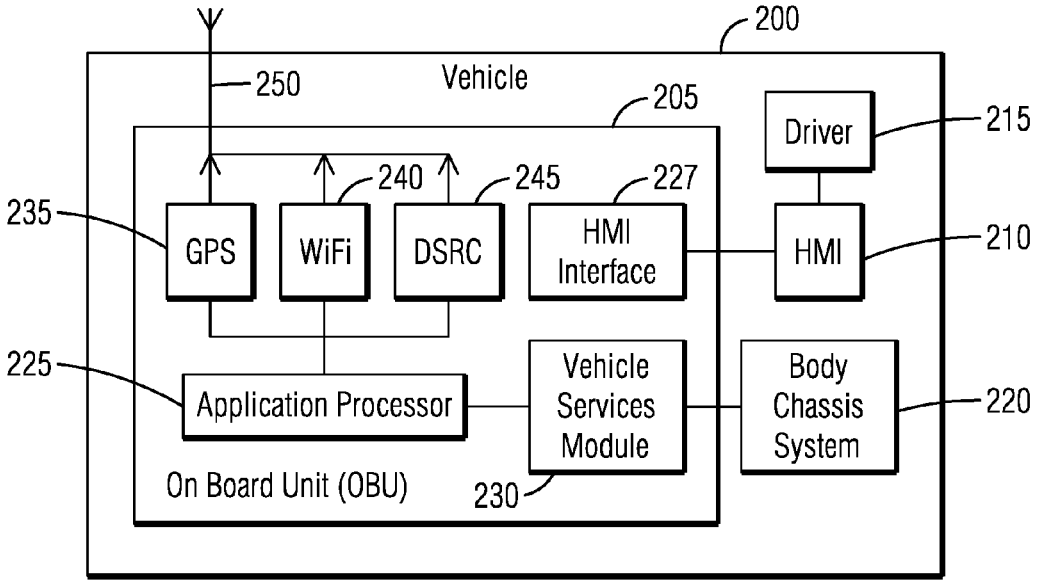
FIG. 2 illustrates a schematic of an Onboard Unit (OBU)-equipped vehicle equipped with an Onboard Unit (OBU) in accordance with an exemplary embodiment of the present invention.

Referring to FIG. 2, it illustrates a schematic of an Onboard Unit (OBU)-equipped vehicle 200 equipped with an Onboard Unit (OBU) 205 in accordance with an exemplary embodiment of the present invention. The OBU-equipped vehicle 200 may include a Human Machine Interface (HMI) 210 for a driver 215 to interface with the OBU 205. The OBU-equipped vehicle 200 may also include a body chassis system 220 to interface with the OBU 205.

In one embodiment, the OBU 205 may include an application processor 225, a HMI interface 227, and a vehicle services module 230. The OBU 205 may further include a GPS chip 235, a Wi-Fi transceiver 240, a Dedicated Short-Range Communications (DSRC) device 245, and an antenna 250 to which they are coupled for conducting wireless communications.

As shown, the HMI interface 227 is coupled to the HMI 210 and the vehicle services module 230 is coupled to the body chassis system 220. The GPS chip 235 provides GPS communications for determining and communicating location of the OBU-equipped vehicle 200. The Wi-Fi transceiver 240 provides communications to Wi-Fi hotspots and other ISP networks to connect the OBU-equipped vehicle 200 to the Internet. As a part of an intelligent transportation system (ITS), the DSRC device 245 may operate as a network node to provide dedicated short-range vehicular communications in 5.9 GHz band with bandwidth of 75 MHz and has an approximate range of 1000 m.

Figure 3:
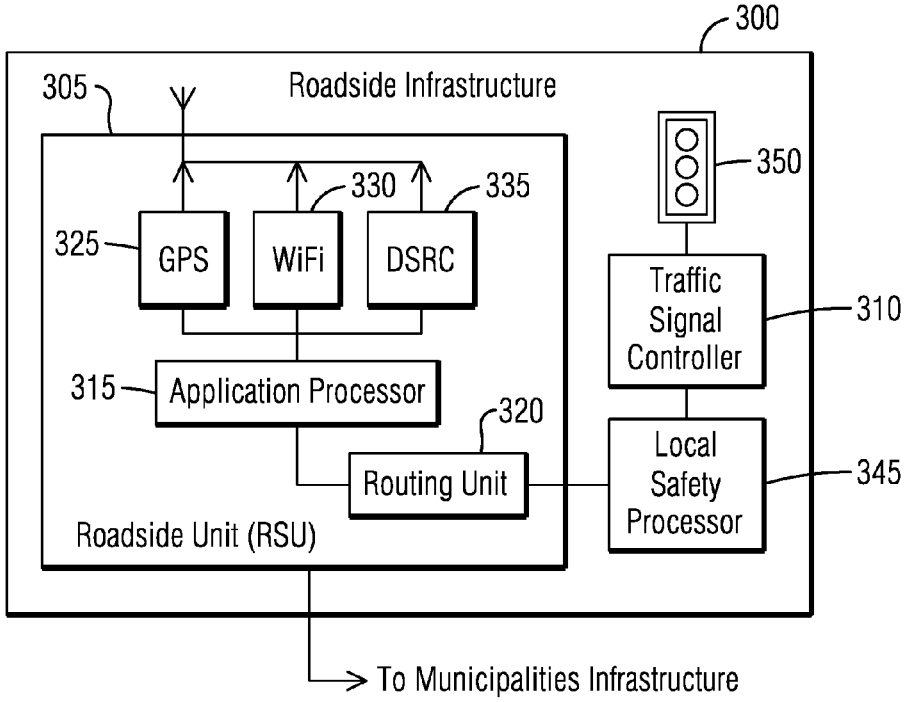
FIG. 3 illustrates a schematic of roadside infrastructure including a Roadside Unit (RSU) and a traffic signal controller in accordance with an exemplary embodiment of the present invention.

Turning now to FIG. 3, it illustrates a schematic of roadside infrastructure 300 including a Roadside Unit (RSU) 305 and a traffic signal controller 310 in accordance with an exemplary embodiment of the present invention. In one embodiment, the RSU 305 may include an application processor 315 and a routing unit 320. The RSU 305 may further include a GPS chip 325, a Wi-Fi transceiver 330, a Dedicated Short-Range Communications (DSRC) device 335, and an antenna 340 to which they are coupled for conducting wireless communications. GPS is one example of a location device. Others include beacons, dead reckoning and other navigation location services.

The routing unit 320 may be coupled to a local safety processor 345 which connects to the traffic signal controller 310 linked to a traffic signal 350. The routing unit 320 may further couple the RSU 305 to the municipalities infrastructure 85 of FIG. 1.

The GPS chip 325 provides GPS communications for determining and communicating location information of a non-OBU-equipped vehicle. The Wi-Fi transceiver 330 provides communications to Wi-Fi hotspots and other ISP networks to connect the RSU 305 to the Internet. As a part of an intelligent transportation system (ITS), the DSRC device 335 may operate as a network node to provide dedicated short-range vehicular communications in 5.9 GHz band with bandwidth of 75 MHz in an approximate range of 1000 m.

Figure 4:
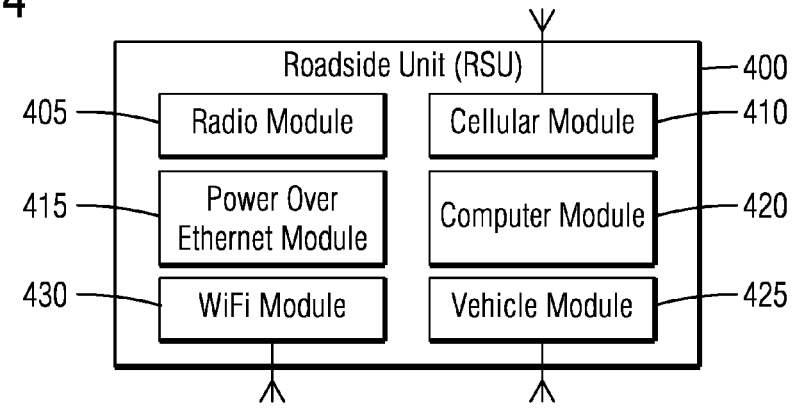
FIG. 4 illustrates a schematic of a Roadside Unit (RSU) in accordance with an exemplary embodiment of the present invention.

FIG. 4 illustrates a schematic of a Roadside Unit (RSU) 400 in accordance with another exemplary embodiment of the present invention. In one embodiment, the RSU 400 may include a radio module 405, a cellular module 410, a power over Ethernet module 415, a computer module 420, a vehicle module 425 and a Wi-Fi module 430. The cellular module 410 may provide mobile communications with cell phones of drivers. The power over Ethernet module 415 may provide a wired Internet connection to the RSU 400. The vehicle module 425 may support a non-Onboard Unit (OBU)-equipped vehicle and/or the Onboard Unit (OBU)-equipped vehicle 15 related activities of the connected vehicle traffic safety system 10 of FIG. 1.

The radio module 405 may include a DSRC device to operate as a network node to provide dedicated short-range vehicular communications in 5.9 GHz band with bandwidth of 75 MHz in an approximate range of 1000 m. The computer module 420 may include a processor to execute a traffic control software stored in a storage device for the RSU 400. The Wi-Fi module 430 provides communications to Wi-Fi hotspots and other ISP networks to wirelessly connect the RSU 400 to the Internet.

Figure 5:
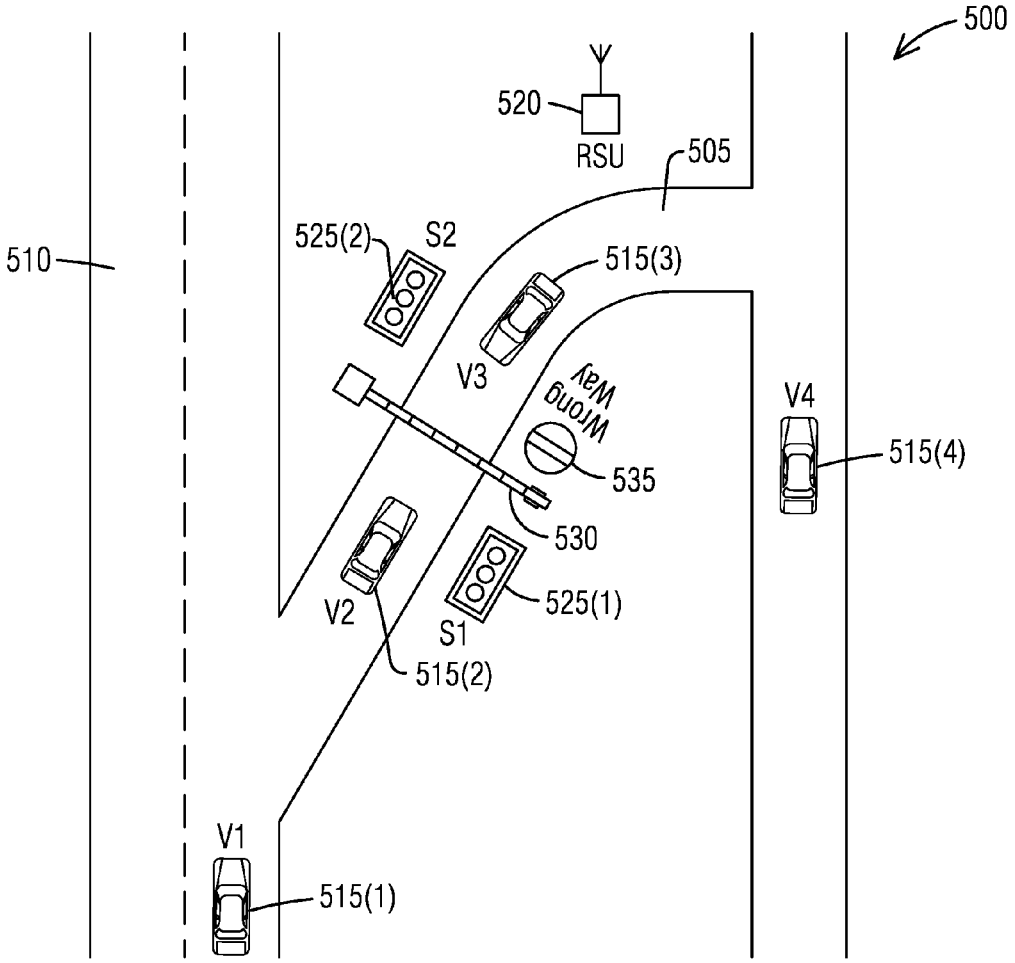
FIG. 5 illustrates a wrong-way vehicle detection system that provides a red light violation warning for collision avoidance in accordance with an exemplary embodiment of the present invention.

As shown in FIG. 5, it illustrates a wrong-way vehicle detection system 500 that provides a red light violation warning for collision avoidance in accordance with an exemplary embodiment of the present invention. FIG. 5 depicts a typical highway exit ramp 505 from a freeway 510, but could depict any one-way traffic lane. In FIG. 5, vehicles V1 515(1), V2 515(2), V3 515(3) and V4 515(4) are equipped with an OBU (Class 1, 2 or 3) and the infrastructure is equipped with an RSU 520 and a traffic signal controller that operates two traffic signals S1, S2 525(1-2) as follows: a) S1 525(1) facing the right-way traffic is set to dwell permanently in GREEN and b) S2 525(2) facing the wrong-way traffic is set to dwell permanently in RED.

An Onboard Unit (OBU) of a second OBU-equipped vehicle V2 515(2) travelling in a correct direction on the highway exit ramp 505 may determine a NO violation based on at least one of vehicle location data, direction heading data, and speed data from the second OBU-equipped vehicle V2 515(2) and the SPaT indication 120 of the GREEN signal phase 94. The Onboard Unit (OBU) of the second OBU-equipped vehicle V2 515(2) travelling in the correct direction on the highway exit ramp 505 may receive the RED light warning 140 with a violator vehicle location and a violator vehicle arrival time of a first OBU-equipped vehicle V3 515(3). An Onboard Unit (OBU) of a third OBU-equipped vehicle V1 515(1) travelling before the highway exit ramp 505 may also receive the RED light warning 140 with a violator vehicle location and a violator vehicle arrival time of the first OBU-equipped vehicle V3 515(3).

Once configured, the wrong-way vehicles may be detected and handled as red light violators using the wrong-way vehicle detection system 500 as follows: a) the RSU 520 transmits Signal Phase and Timing (SPaT) data for both signal phases: i) RED phase SPaT continually indicates maximum countdown time to GREEN ii) GREEN phase SPaT continually indicates maximum countdown time to RED, b) the RSU 520 transmits a MAP message indicating the roadway lane placement for both RED and GREEN approaches, c) the RSU 520 transmits GPRS location corrections to all vehicles for accurate vehicle location within lanes, d) the vehicle V2 515(2) travelling in the right direction calculates no violations based on location, heading, speed data and the GREEN SPaT data, e) the vehicle V3 515(3) travelling in the wrong direction calculates Red light violation from location, heading, speed data and the RED SPaT data, f) the vehicle V3 515(3) driver receives a red light warning, such as chattering the braking system or the driver's seat, and g) If the vehicle V3 515(3) driver ignores the warning: i) a barrier 530 is dropped and a wrong way sign 535 is illuminated and ii) the vehicles V1 515(1) and V3 515(3) receive a warning of a violator location and an arrival time.

Advantages of the embodiments of the present invention include: a). red light violation methodology is implemented for a single lane of traffic via use of signalized intersections, b). no additional roadside hardware or software is required beyond the standard RSU 520 and a red light violation APP, and c). nearby drivers are warned of predicted wrong-way crashes, a common cause of fatalities.

The RSU 520 software may create and transmit the following Connected Vehicle SAE Standard J2735 messages to nearby OBU-equipped vehicles: a) Lane Placement (MAP) message of the exit ramp lane geometries, b) Signal Phase and Timing (SPaT) message of a signal color to a lane association, plus a signal countdown, and c) GPRS navigation corrections to vehicles with inaccurate standard GPS devices.

Combined with the Basic Safety Message (BSM) from nearby vehicles, the wrong-way vehicle detection system 500 has the advantage of predicting wrong-way violation before they occur and to warn approaching vehicles of wrong-way violators in time to avoid collisions at distances of 400 meters or more.

Figure 6:
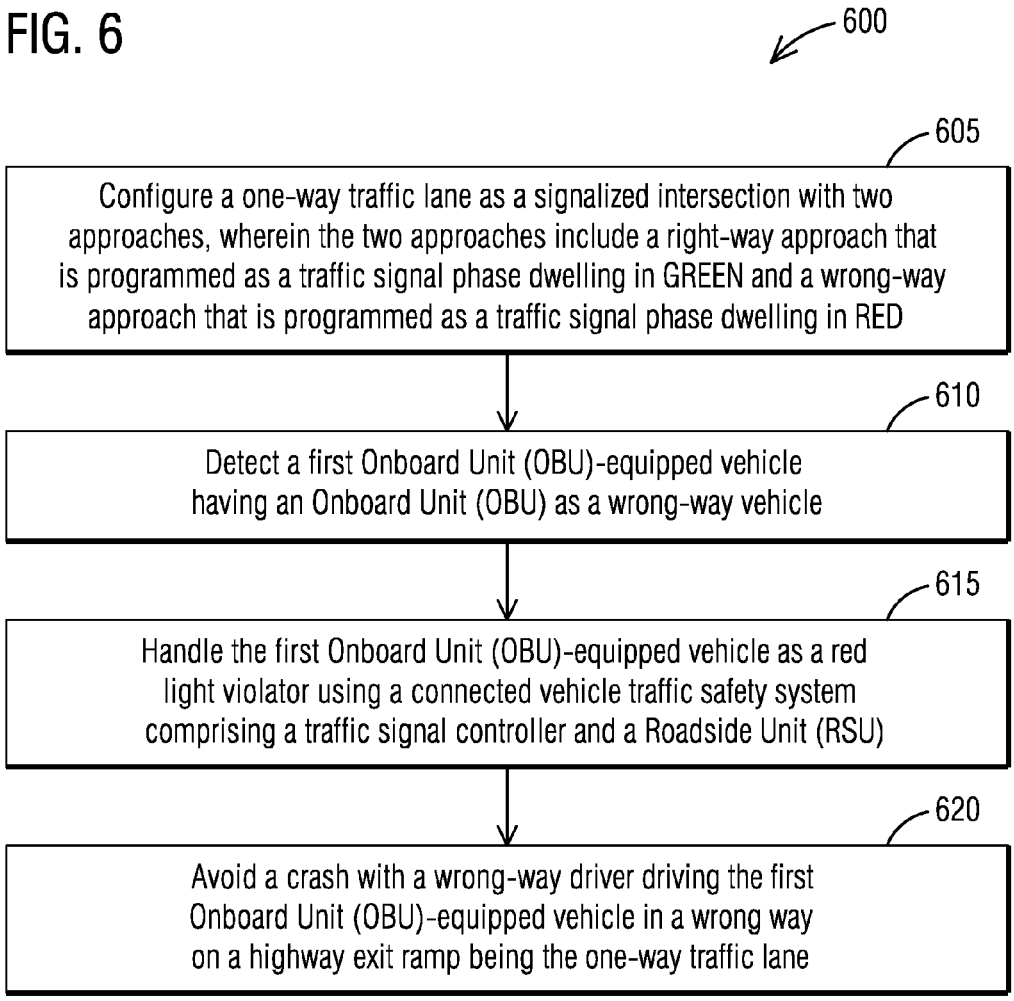
FIG. 6 illustrates a flow chart of a method of avoiding crashes with a driver driving a first Onboard Unit (OBU)-equipped vehicle having an Onboard Unit (OBU) in a wrong way on a highway exit ramp being a one-way traffic lane in accordance with an exemplary embodiment of the present invention.

As seen in FIG. 6, it illustrates a flow chart of a method 600 of avoiding crashes with a driver driving the first Onboard Unit (OBU)-equipped vehicle 15 having the Onboard Unit (OBU) 35 in a wrong way on the highway exit ramp 70 being the one-way traffic lane 72 in accordance with an exemplary embodiment of the present invention. Reference is made to the elements and features described in FIGS. 1-5. It should be appreciated that some steps are not required to be performed in any particular order, and that some steps are optional.

The method 600 includes, in step 605, configuring the one-way traffic lane 72 as the signalized intersection 125 with two approaches. The two approaches include the right-way approach 127(1) that is programmed as a traffic signal phase dwelling in GREEN and the wrong-way approach 127(2) that is programmed as a traffic signal phase dwelling in RED. The method 600 further includes, in step 610, detecting the first Onboard Unit (OBU)-equipped vehicle 15 as a wrong-way vehicle. The method 600 further includes, in step 615, handling the first Onboard Unit (OBU)-equipped vehicle 15 as a red light violator using the connected vehicle traffic safety system 10 comprising the traffic signal controller 75 and the Roadside Unit (RSU) 30. In this way, the method 600, in step 620, may avoid a crash with a wrong way driver on the highway exit ramp 70 being the one-way traffic lane 72.

The method 600 further comprises operating first and second traffic signals S1, S2 80(1-2) by the traffic signal controller 75. The first traffic signal S1 80(1) is facing a right-way traffic and is set to dwell permanently in a GREEN signal phase and the second traffic signal S2 80(2) is facing a wrong-way traffic and is set to dwell permanently in a RED signal phase. The method 600 further comprises transmitting a Signal Phase and Timing (SPaT) indication for both the GREEN signal phase and the RED signal phase by the roadside unit (RSU) 30 located at the highway exit ramp 70.

The method 600 further comprises calculating the RED light violation 135 by the Onboard Unit (OBU) 35 of the first OBU-equipped vehicle 15 travelling in a wrong direction based on at least one of vehicle location data, direction heading data, and speed data from the first OBU-equipped vehicle 15 and the SPaT indication 122 of the RED signal phase 98. The method 600 further comprises providing the RED light warning 140 to the driver 145 of the first OBU-equipped vehicle 15 in a form of chattering the braking system 150 or the driver's seat 155 to indicate the first OBU-equipped vehicle 15 as a wrong-way vehicle that is to be handled as a red light violator. If the driver 145 of the first OBU-equipped vehicle 15 ignores the RED light warning 140, the method 600 further comprises either dropping the barrier 530 across the highway exit ramp 70 and/or illuminating the wrong way sign 535 adjacent the second traffic signal S2 80(2) by the traffic signal controller 75.

The connected vehicle traffic safety system 10 may use Dedicated Short-Range Communications (DSRC) as a medium range wireless communication channel dedicated to OBU vehicles to provide communications from Vehicle to either another Vehicle (V2V) or to roadside Infrastructure (V2I). On-Board-Units (OBUs) may be retrofitted to existing cars or built into new cars, with the goal of creating an ecosystem of connected vehicles.

As the primary threat to any vehicle comes from other vehicles, the connected vehicle traffic safety system 10 may enable vehicles to exchange information about themselves with other vehicles in the vicinity, and vice versa. The OBU vehicles could communicate highly accurate information such as speed, acceleration, steering angle, existence of a trailer, failure of a headlight or brake light, etc—to offer near-instantaneous feedback to enable evasive or preventive action. Such information would provide highly reliable, real-time situational awareness based on which smart decisions can be taken.

With the use of smart infrastructure equipment connected to weather/environmental systems, traffic signal light controllers and traffic management systems, the connected vehicle traffic safety system 10 may enable the OBU vehicles to now make use of real-time information to make smarter and safer decisions. The OBU vehicles are enabled to know the status of infrastructure, for example the approaching traffic light. In this way, the OBU vehicles are better equipped to make decisions that affect travel time, routes and fuel consumption.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A connected vehicle traffic safety system, comprising:

a traffic signal controller configured to operate first and second traffic signals S1, S2 or configured to act as if a traffic signal was present as a "virtual" traffic signal, wherein the first traffic signal S1 is facing a right-way traffic and is set to dwell permanently in a GREEN signal phase and the second traffic signal S2 is facing a wrong-way traffic and is set to dwell permanently in a RED signal phase; and a roadside unit (RSU) configured to be located at a highway exit ramp being a one-way traffic lane, the roadside unit (RSU) comprising at least a processor and a wireless transceiver, wherein the roadside unit (RSU) configured to transmit wireless signals and receive corresponding responses from a corresponding wireless device of a first Onboard Unit (OBU)-equipped vehicle having an Onboard Unit (OBU), wherein the roadside unit (RSU) is configured to transmit a Signal Phase and Timing (SPaT) indication for both the GREEN signal phase and the RED signal phase, the SPaT indication of the RED signal phase continually indicates a maximum countdown time to the GREEN signal phase and the SPaT indication of the GREEN signal phase continually indicates a maximum countdown time to the RED signal phase, wherein the one-way traffic lane is configured as a signalized intersection with two approaches, wherein the two approaches include a right-way approach that is programmed as a traffic signal phase dwelling in GREEN and a wrong-way approach that is programmed as a traffic signal phase dwelling in RED, and wherein the Onboard Unit (OBU) of the first OBU-equipped vehicle travelling in a wrong direction is configured to calculate a RED light violation based on at least one of vehicle location data, direction heading data, and speed data provided from the first OBU-equipped vehicle and the SPaT indication of the RED signal phase.

2. The system of claim 1, wherein the Onboard Unit (OBU) of the first OBU-equipped vehicle provides a RED light warning based on the RED light violation to a driver of the first OBU-equipped vehicle in a form of chattering a braking system or a driver's seat to indicate the first OBU-equipped vehicle as a wrong-way vehicle that is to be handled as a red light violator.

3. The system of claim 2, wherein the roadside unit (RSU) is configured to send the at least one of vehicle location data, direction heading data, and speed data from the first OBU-equipped vehicle to the traffic signal controller so that if the driver of the first OBU-equipped vehicle ignores the RED light warning, at least one of a barrier is dropped across the highway exit ramp and a wrong way sign is illuminated adjacent the second traffic signal S2 by the traffic signal controller.

4. The system of claim 3, wherein an Onboard Unit (OBU) of a second OBU-equipped vehicle traveling in a correct direction on the highway exit ramp is configured to determine a NO violation based on at least one of vehicle location data, direction heading data, and speed data from the second OBU-equipped vehicle and the SPaT indication of the GREEN signal phase.

5. The system of claim 2, wherein an Onboard Unit (OBU) of a second OBU-equipped vehicle traveling in a correct direction on the highway exit ramp to receive the RED light warning with a violator vehicle location and a violator vehicle arrival time of the first OBU-equipped vehicle.

6. The system of claim 2, wherein an Onboard Unit (OBU) of a third OBU-equipped vehicle traveling before the highway exit ramp to receive the RED light warning with a violator vehicle location and a violator vehicle arrival time of the first OBU-equipped vehicle.

7. The system of claim 1, wherein the roadside unit (RSU) is configured to transmit a Message Access Profile (MAP) message indicating a roadway lane placement for both RED and GREEN approaches.

8. The system of claim 1, wherein the roadside unit (RSU) is configured to transmit General Packet Radio Service (GPRS) location corrections to all OBU-equipped vehicles for accurate vehicle location within lanes.

9. The system of claim 1, wherein the Onboard Unit (OBU) of the first OBU-equipped vehicle is configured to at least one of:

transmit vehicle location, heading and speed data to nearby OBU-equipped vehicles ten times per second;

receive vehicle location, heading and speed data from nearby OBU-equipped vehicles;

receive lane locations from the roadside unit (RSU);

receive a traffic signal countdown from the roadside unit (RSU);

receive an associated signal phase to a lane information from the roadside unit (RSU) to know which traffic signal to obey; and receive a General Packet Radio Service (GPRS) location from the roadside unit (RSU) to correct a Global Positioning System (GPS) device the Onboard Unit (OBU) having less accuracy.

10. The system of claim 1, wherein the one-way traffic lane is configured as a signalized intersection with two approaches.

11. The system of claim 10, wherein the two approaches include a right-way approach that is programmed as a traffic signal phase dwelling in GREEN and a wrong-way approach that is programmed as a traffic signal phase dwelling in RED.

12. A method to avoid crashes with wrong-way drivers driving a first Onboard Unit (OBU)-equipped vehicle having an Onboard Unit (OBU) in a wrong way on a highway exit ramp being a one-way traffic lane, the method comprising:

configuring a traffic signal controller for the one-way traffic lane as a signalized intersection with two approaches, wherein the two approaches include a right-way approach that is programmed as a traffic signal phase dwelling in GREEN and a wrong-way approach that is programmed as a traffic signal phase dwelling in RED;

transmitting a Signal Phase and Timing (SPaT) indication for the RED signal phase, wherein the SPaT indication of the RED signal phase continually indicates a maximum countdown time to the GREEN signal phase;

detecting the first Onboard Unit (OBU)-equipped vehicle as a wrong-way vehicle; and handling the first Onboard Unit (OBU)-equipped vehicle as a red light violator using a connected vehicle traffic safety system comprising the traffic signal controller and a roadside unit (RSU).

13. The method of claim 12, further comprising:

operating first and second traffic signals S1, S2 by the traffic signal controller, wherein the first traffic signal S1 is facing a right-way traffic and is set to dwell permanently in a GREEN signal phase and the second traffic signal S2 is facing a wrong-way traffic and is set to dwell permanently in a RED signal phase.

14. The method of claim 13, further comprising:

transmitting the Signal Phase and Timing (SPaT) indication for the GREEN signal phase by the RSU located at the highway exit ramp, wherein the SPaT indication of the GREEN phase continually indicates a maximum countdown time to the RED signal phase.

15. The method of claim 14, further comprising:

calculating a RED light violation by the Onboard Unit (OBU) of the first OBU-equipped vehicle traveling in a wrong direction based on at least one of vehicle location data, direction heading data, and speed data from the first OBU-equipped vehicle and the SPaT indication of the RED signal phase.

16. The method of claim 15, further comprising:

providing a RED light warning to a driver of the first OBU-equipped vehicle in a form of chattering a braking system or a driver's seat to indicate the first OBU-equipped vehicle as a wrong-way vehicle that is to be handled as a red light violator.

17. The method of claim 16, further comprising:

if the driver of the first OBU-equipped vehicle ignores the RED light warning, at least one of dropping a barrier across the highway exit ramp and illuminating a wrong way sign adjacent the second traffic signal S2 by the traffic signal controller.

18. A connected vehicle traffic safety system, comprising:

a traffic signal controller configured to operate a traffic signal or configured to act as if a traffic signal was present as a "virtual" traffic signal, wherein the traffic signal is facing a wrong-way traffic and is set to dwell permanently in a RED signal phase; and a roadside unit (RSU) configured to be located at a one-way traffic lane, wherein the one-way traffic lane is configured as a signalized intersection with a wrong-way approach that is programmed as a traffic signal phase dwelling in RED, wherein the roadside unit (RSU) is configured to transmit a Signal Phase and Timing (SPaT) indication for the RED signal phase, wherein the SPaT indication for the RED signal phase continually indicates a maximum countdown time to the GREEN signal phase, wherein a first Onboard Unit (OBU)-equipped vehicle having an Onboard Unit (OBU) that is configured to calculate a RED light violation based on at least one of vehicle location data, direction heading data, and speed data provided from the first OBU-equipped vehicle and the SPaT indication of the RED signal phase to detect the first Onboard Unit (OBU)-equipped vehicle as a wrong-way vehicle.

19. The system of claim 18, wherein for handling the first Onboard Unit (OBU)-equipped vehicle as a red light violator the Onboard Unit (OBU) of the first OBU-equipped vehicle provides a RED light warning to a driver of the first OBU-equipped vehicle in a form of chattering a braking system or a driver's seat.

20. The system of claim 19, wherein if the driver of the first OBU-equipped vehicle ignores the RED light warning, at least one of a barrier is dropped across the highway exit ramp and a wrong way sign is illuminated adjacent the traffic signal by the traffic signal controller.

* * * * *